US008522697B2

(12) United States Patent
Corbani

(10) Patent No.: US 8,522,697 B2
(45) Date of Patent: Sep. 3, 2013

(54) WASTE DISPOSAL PLANT WITH MODULAR FRAME AND GUIDE ASSEMBLY

(75) Inventor: Emanuele Corbani, La Spezia (IT)

(73) Assignee: TM.E. S.p.A., La Spezia (IT)

( * ) Notice: Subject to any disclaimer, the term of this patent is extended or adjusted under 35 U.S.C. 154(b) by 0 days.

(21) Appl. No.: 13/511,986

(22) PCT Filed: Nov. 19, 2010

(86) PCT No.: PCT/EP2010/007026

§ 371 (c)(1),
(2), (4) Date: Sep. 25, 2012

(87) PCT Pub. No.: WO2011/063911

PCT Pub. Date: Jun. 3, 2011

(65) Prior Publication Data

US 2013/0008357 A1 Jan. 10, 2013

(30) Foreign Application Priority Data

Nov. 26, 2009 (IT) ..... TO2009A0919

(51) Int. Cl.
*F23H 7/14* (2006.01)
*F23K 3/12* (2006.01)
*F23K 3/00* (2006.01)

(52) U.S. Cl.
USPC ..... 110/281; 110/291; 110/267

(58) Field of Classification Search
USPC ..... 52/111; 104/242, 245, 247; 110/257, 110/267, 278, 285, 281, 282, 291
See application file for complete search history.

(56) References Cited

U.S. PATENT DOCUMENTS

| | | | | |
|---|---|---|---|---|
| 1,759,042 | A | | 5/1930 | De Carie |
| 1,916,916 | A | * | 7/1933 | Booth ..... 451/146 |
| 3,239,618 | A | * | 3/1966 | Sengel ..... 200/61.18 |
| 4,246,851 | A | | 1/1981 | Bergh |
| 4,656,956 | A | | 4/1987 | Flickinger et al. |
| 5,470,033 | A | * | 11/1995 | Tsai et al. ..... 244/110 E |
| 6,024,031 | A | | 2/2000 | Stiefel |

FOREIGN PATENT DOCUMENTS

| | | |
|---|---|---|
| EP | 0 874 195 | 10/1998 |
| EP | 1 635 114 | 3/2006 |
| WO | WO 2008/000047 | 1/2008 |

OTHER PUBLICATIONS

International Search Report for International Application No. PCT/EP2010/007026 mailed May 12, 2011.

* cited by examiner

*Primary Examiner* — Kenneth Rinehart
*Assistant Examiner* — Tiffany Johnson
(74) *Attorney, Agent, or Firm* — Merchant & Gould P.C.

(57) ABSTRACT

A waste disposal plant includes a combustion chamber (2) inside which waste laid on a combustion grate (3) is burnt, which permits the entrance of an adequate quantity of combustion air in the chamber. The combustion grate includes a handling group formed by fire bars or plates (7), which move alternatively one with respect to the other by advancing the waste on the grate. The handling group permits the alternate movement of the fire bars (7) which are divided in movable fire bars (7*a*) and fixed fire bars (7*b*), alternately disposed one with respect to the other, on transversal rows resting one upon the other according to a longitudinal placement with alternate steps.

8 Claims, 5 Drawing Sheets

WASTE DISPOSAL PLANT WITH MODULAR FRAME AND GUIDE ASSEMBLY

This application is a National Stage Application of PCT/EP2010/007026, filed 19 Nov. 2010, which claims benefit of Serial No. TO2009A000919, filed 26 Nov. 2009 in Italy and which application(s) are incorporated herein by reference. To the extent appropriate, a claim of priority is made to each of the above disclosed applications.

BACKGROUND

The present invention relates to a combustion grate, having a modular frame, and being installed in the furnace of a waste disposal plant, in which the aforesaid waste is burnt and so disposed of as ashes.

Such disposal generally comprises also an energy recovery system through the production of overheated steam and the exploitation of steam in a turbine, which in turn is coupled to an electric generator.

Such plants generally comprise a combustion chamber inside which the waste laid on a combustion grate is burnt, through which an adequate quantity of air is inputted. The combustion grate is adapted to sustain and advance the waste during the combustion permitting at the same time the insufflation of combustion air under the waste bed. The grate forms the lower portion of the combustion chamber. The combustion chamber begins physically immediately above the grate. In some cases, the walls of the combustion chamber are completely or partially cooled, by means of evaporation tube bundles protected by the refractory material itself. The region at the interface between grate and combustion chamber is made by the refractory-carrying beam. Inside the combustion chamber, the flame produced by the combustion of waste is spread, reaching temperatures over 1400° C. The surface of the grate is hit only occasionally by the radiation of the flame, as it is normally protected by the waste bed in transit.

The surface of the grate is made by plates (typically called "fire bars") which are normally made of molten steel having a high chromium content, in order to show high wear characteristics when hot. The advancement of waste is obtained through the relative movement of the fire bars which can have several characteristics. The actuation system is normally made of hydraulic pistons. The fire bars are provided with apertures or holes to allow the combustion air to flow from underneath the plane of the grate, through the waste. The combustion air has in fact the double function of providing the oxygen for the oxidation of the waste and of cooling the fire bar by maintaining it at an acceptable temperature in order to maintain the mechanical characteristics. The cooling is necessary, as the grates normally work covered by the forwarded fuel, but they can also be directly exposed to the combustion flames.

The steps making the grate can also be provided with an additional cooling system with water, particularly when they are used for the combustion of fuels with high calorific power. Such cooling is obtained by a liquid circulation which is forced to lap the surfaces which do not contact the fuel of each fire bar, through a liner or an equivalent apparatus for the accumulation of liquid.

The fire bars at the initial and terminal ends of each step are separated from the carrying structure of the grate by means of plates, generally of the same material of the fire bar, which are approached with pressure against the side of the side bar itself. Such plates have the function of laterally containing the fuel forwarded in the region immediately above the fire bars, and of separating it from the lateral portions of the grate, which do not tolerate the direct exposition to the burning material. The lateral plates eventually join the plane made by the fire bars with the vertical surfaces of the combustion chamber, which are disposed immediately above the grate.

The grate further comprises a plurality of handling groups, each formed by the cited fire bars organized in bundles, which relatively move one with respect to the other advancing the waste on the grate. In particular, the fire bars are divided into fixed and movable fire bars, which through slides cause a back-and-forth movement, by sliding one on another and determining the advancement of the waste in each handling group, and so in general on the grate.

The disposal of the solid urban waste, even if it is not characterized by a highest technological content, is an activity particularly sensible from a point of view of the reliability and the guarantees of the function. The complex integrated system of the waste disposal (the accumulation, the collection, the transport, the stockpiling and the disposal) requires that the technological components employed in the last stage of the supply chain permit a continuous operation over 24 hours and minimize the risks of stopping due to damages (minor or catastrophic damages as they can be). The operator of the disposal plant requires reliability, robustness and simplicity of the component "grate", both in the operation and in the maintenance stage.

Patent application MI2004A001746 describes a plant of this kind having a movable combustion grate, in which the handling group is formed by a plurality of fire bars, which alternatively move one with respect to the other by advancing the waste on said grate, which realizes a substantially horizontal and at least partially continuous combustion plane.

The movable fire bars are bound to a movable frame, which is pushed by two pistons, one on each side. The fixed fire bars are in turn connected with a fixed frame, common to all fixed fire bars.

The relative movement between the fixed frame and the movable frame is of a simple alternate translation.

The grate is further provided with sliding elements adapted to determine the sliding between the two frames and elements limiting the movement between them which determine its stroke.

In the forward stroke the movable fire bar pushes the waste on the back of the fixed fire bar until causing its fall onto the subsequent movable fire bar, and at the same time it drags the waste on its own back. In the return stroke, the waste on the back of the movable fire bar finds an obstacle on the front of the fixed fire bar and, instead of moving back, it is pushed onto the back of the fixed fire bars downwards and then it is pushed forwards in the subsequent displacement, so determining the advancement of the waste in each handling group on the grate in general.

The sliding elements are substantially made by bearings or rolls upon which a pad slides substantially integrally with the moveable frame with an inclination dependent on the direction of movement which the moveable frame must communicate to the fire bars.

The movement limiting elements comprise a track integral with the carrying or fixed frame, whereas to the movable frame of the grate two wheels are in turn connected, bound to a fixed axis. The wheels are mounted with a transversal clearance with respect to the track. When the movable frame moves in different directions with respect to that required for the correct feeding of the fire bar, the clearance between the wheels and the frame is reduced until becoming zero by stopping the movement of the movable frame.

Such typical sliding elements are unavoidably subjected to dust accumulations between the surfaces of the rolls, which can impair the correct lubrication of the roll bearings and cause a rapid wear of the bearing themselves or finally their seizure. Furthermore, such movement limiting elements are bulky and have a remarkable constructive complexity. Their encumbrance requires that they be positioned proximal to the symmetry axis of the module of the grate, so rendering them accessible with difficulty for the lubrication and the maintenance.

SUMMARY

The Applicant has realized a waste disposal plant in which in each handling group the sliding elements and the movement limiting elements are mutually integrated in a single ergonomic assembly.

Consequently the present invention solves the above mentioned drawbacks by realizing a waste disposal plant.

BRIEF DESCRIPTION OF THE DRAWINGS

The characteristics and advantages of the plant according to the present invention will be better clarified and evident from the following, by way of example and non limitative, description of an embodiment with reference to the annexed figures, in which.

DETAILED DESCRIPTION

Figure 1:
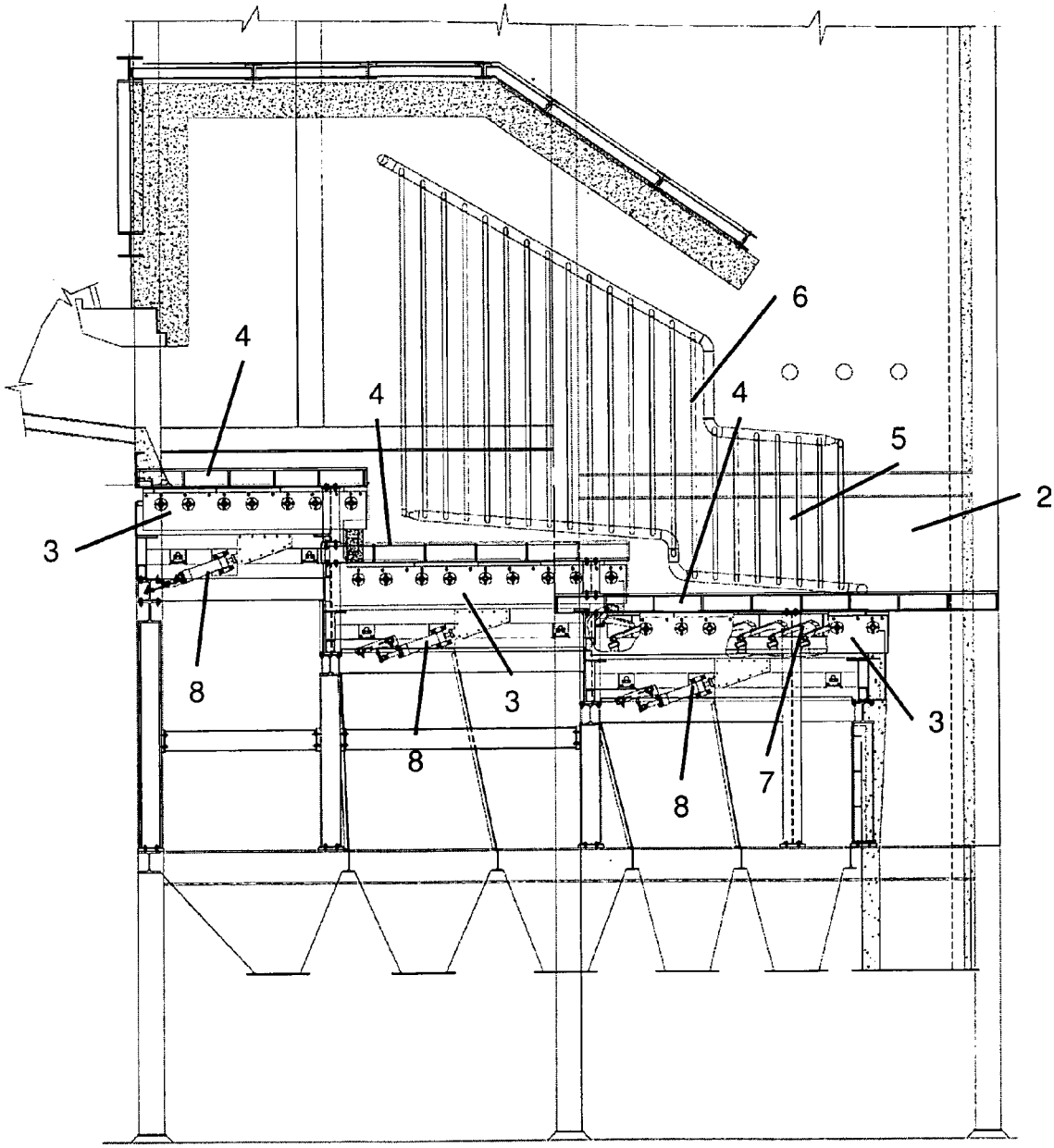
FIG. 1 is a schematic presentation of a waste disposal plant according to the known art, which provides for a three-level combustion grate.
Figure 2:
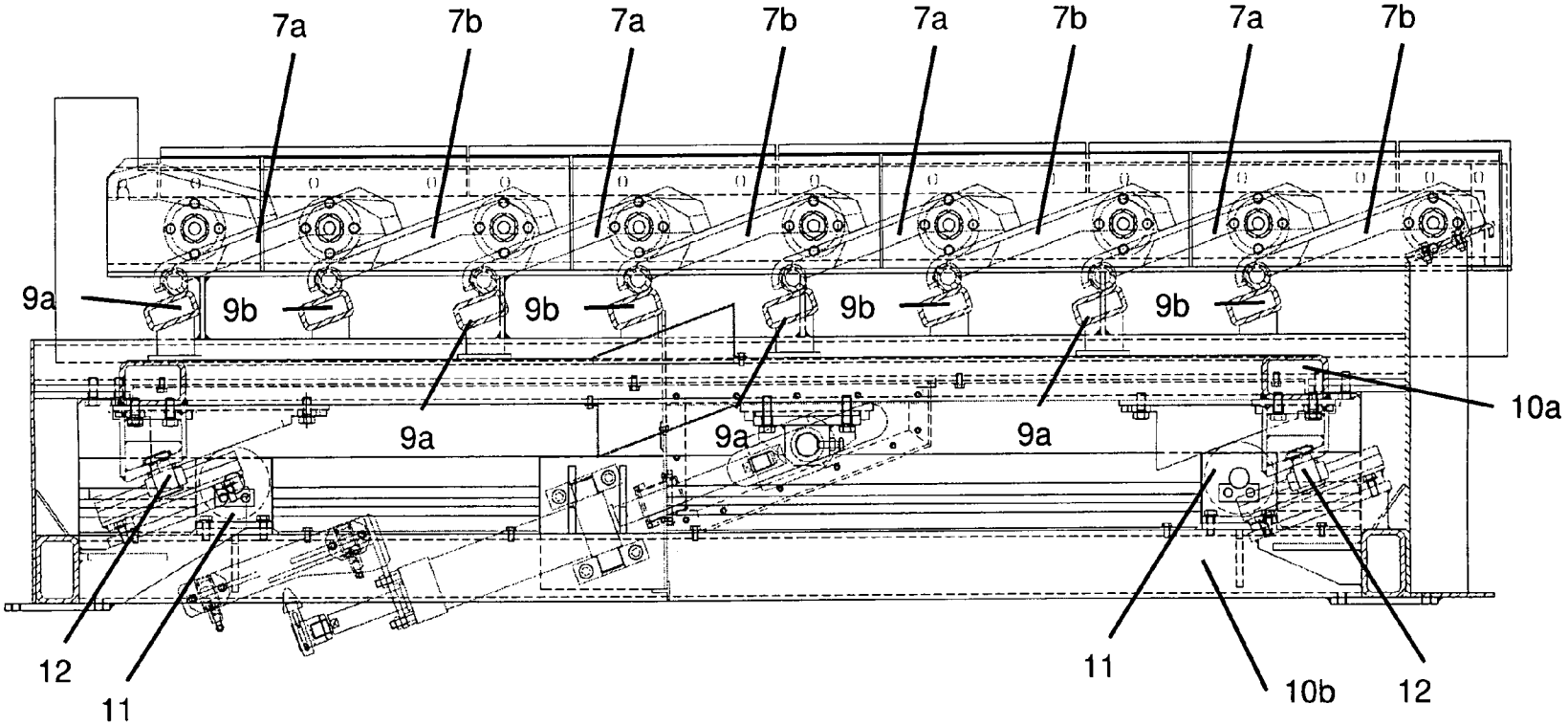
FIG. 2 is a schematic presentation of a handling group of the grate of the plant of FIG. 1.

With reference to cited figures a typical waste disposal plant comprises a combustion chamber 2 inside which the waste disposed on a combustion grate 3 are burnt, through which an adequate quantity of combustion air is inputted.

The grate forms the lower region of the combustion chamber, above which a beam 4 is present, which has also the function of supporting lateral refractory walls 5. Preferably, the walls of the combustion chamber are completely or partially cooled, through evaporating tube bundles 6 which are protected by the refractory material itself.

The combustion grate comprises at least a handling group made by a plurality of fire bars 7, which move alternately one with respect to the other by advancing the waste on the grate.

In the example of embodiment shown in FIG. 1 there are three handling groups disposed offset one with respect to the other, in order to obtain a horizontal discontinuous placement (stepped or with jumps). Alternatively, still within the present invention, it is possible to obtain a slightly inclined placement (up to 15°), without substantial modifications.

Each handling group is actuated by handling means 8 made for example by at least a hydraulic piston. Such handling means permit the alternate movement of fire bars 7 which are divided in movable fire bars 7*a* and fixed fire bars 7*b*, alternately disposed one with respect to the other, on transversal rows resting one on the other according to a longitudinal disposition with alternate steps, respectively with one fixed and one movable.

The movable fire bars are connected to movable beams 9*a* and are bound to a movable frame 10*a*, which is pushed by two pistons, one on each side. The fixed fire bars are in turn connected through fixed beams 9*b* with a fixed frame 10*b* common to all fixed fire bars.

The relative movement between the fixed frame and the movable frame is of a simple alternate translation. The relative movement of the fire bars is of an alternate translation preferably according to a direction inclined of 20° on the horizontal.

The grate is also provided with sliding elements 11 adapted to determine the sliding between the two frames and elements 12 limiting the movement between them, which determine their movement according to predefined trends.

In the forward stroke the movable fire bar pushes the waste on the back of fixed fire bar 7*b* until causing its fall from the subsequent movable fire bar, and at the same time it drags the waste on its own back. In the return stroke the waste on the back of the movable fire bar finds an obstacle in the front of the fixed fire bar, and instead of going back, it is pushed downwards onto the back of the fixed fire bar and therefore it is pushed forward in the subsequent movement, by determining the advancement of the waste in each handling group and then on the grate in general.

Figure 3:
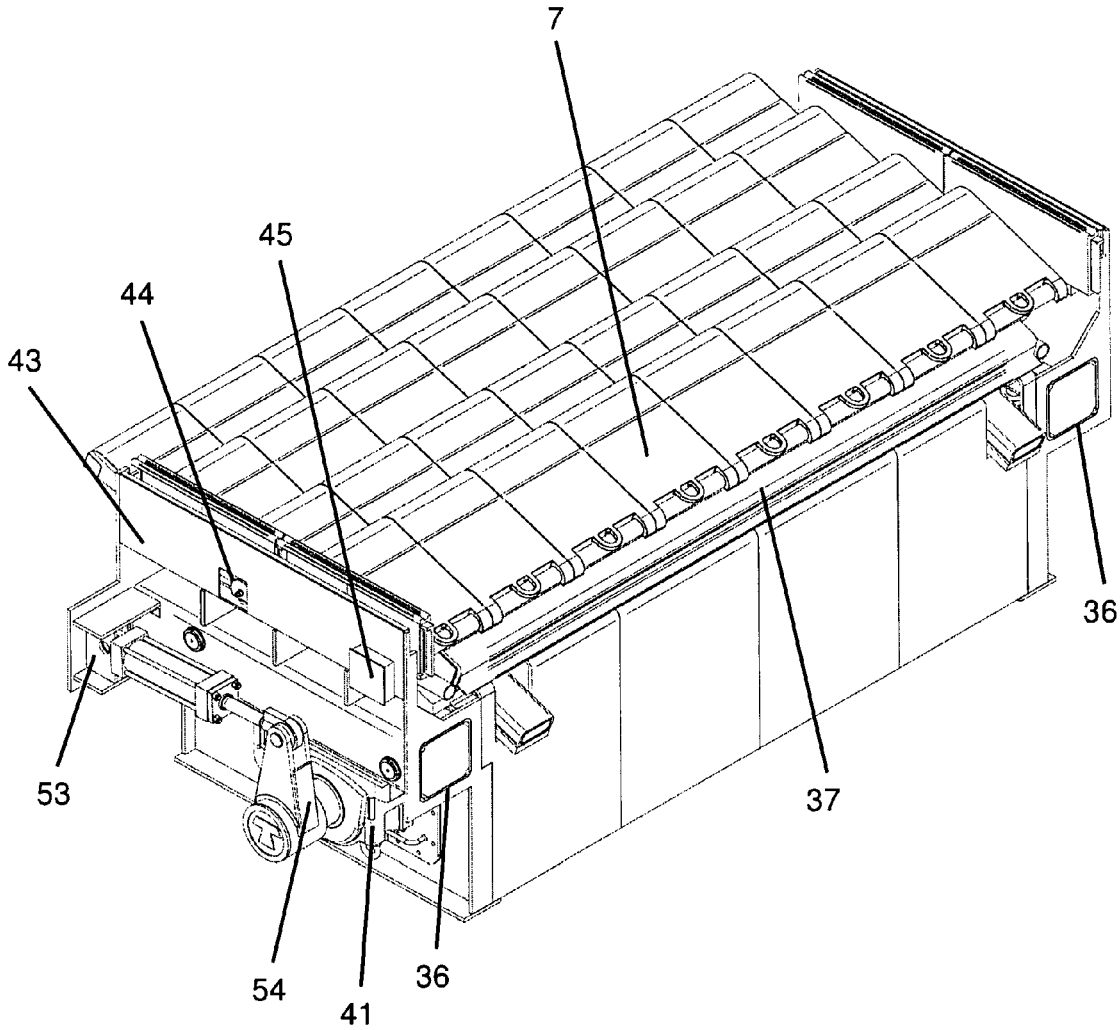
FIG. 3 is a perspective view of the upper portion of the grate according to the present invention, usable in the plant of FIG. 1.
Figure 4:
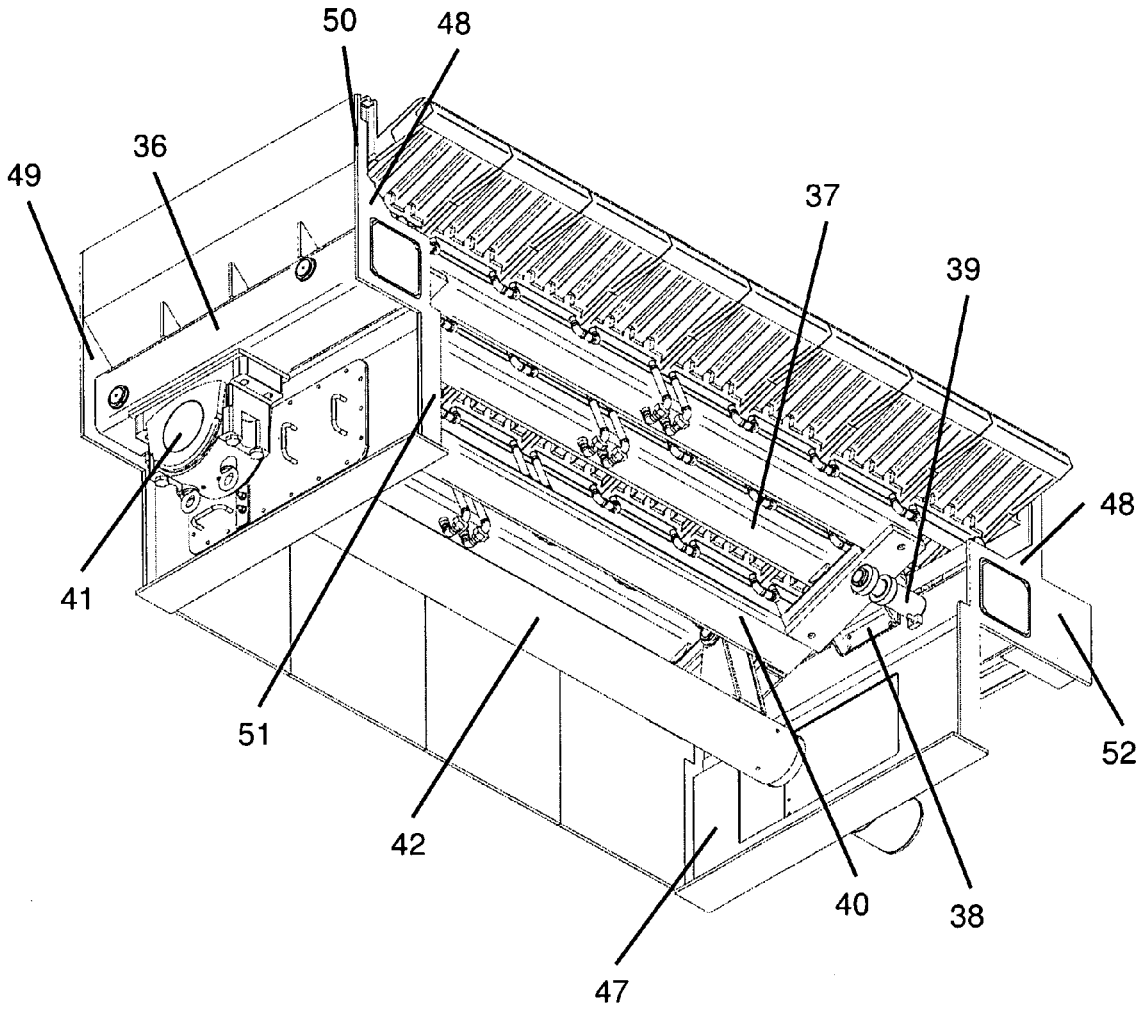
FIG. 4 is a perspective view of the lower portion of the grate according to the present invention usable in the plant of FIG. 1.

In FIGS. 3 and 4 a handling group of the grate is illustrated according to the present invention, comprising a carrying frame including two lateral beams 36 and two transversal cross-beams 37. Lateral beams 36 are preferably realized with a closed square or rectangular cross section and are connected to cross-beams 37 by means of a knot 38 structurally equivalent to a joint, positioned on the upper portion of lateral beams 36 themselves. Knot 38 also comprises a reference (plug or equivalent device—non represented) which permits to precisely position cross-beams 37 with respect to lateral beams 36 during the assembly of the module of the grate. Inside lateral beams 36 axes of wheel assemblies 39 are mounted, which permit the relative movement between the carrying frame and movable frame 40. To the lower portion of beams 36 the supports of bearings 41 of actuating shafts 42 are on the contrary fixed.

To the upper portion of beams 36 an upper sheet 43 is fixed. Such sheet separates the lateral plates from the outside and forms the connecting element between the carrying frame and the upper portion of the furnace (non represented), for example comprising thermal insulating panels and respective fixing sheeting. On upper sheet 43 apertures 44 are formed which permit the access to the sealing elements of the lateral plates. Apertures 44 must be air-tightly closed through flanges 45, doors or other closures of equivalent function. To the lower portion of beams 36 a lower non-structural sheet 47 is instead fixed. Sheet 47 together with beams 36 delimits from the two sides of the module of the grate the pressurized volume which provides supply air to fire bars 7. To the front and back ends of beams 36 two flanges 48 and 49 are fixed, whose outer surfaces are made to match in order to couple two successive modules, for example through bolts with gasket or other equivalent air-tight connection. Flanges 48 and 49 are provided with upper extensions 50 and lower extensions 51, which permit to directly couple two successive modules also at upper sheets 43 and of lower sheets 47. Front flanges 48 are finally provided with a lateral extension 52 to which a connection element 53 is fixed, for the hydraulic cylinder moving actuating shaft 42. The handling of the actuating shaft takes place through a lever 54 fitted flush on shaft 42 itself.

Beams 36 as well as having a structural function incorporate the seats of all the inner and outer mechanical parts of the module of the grate, lateral sheets 43 and 47, which make the sides of the module itself and connecting flanges between successive modules.

Due to the fact that the support cross-beams of the fire bars are structural elements in the present invention, the assembly of the carrying frame of each module requires exclusively the coupling of beams 36 specular for the two sides of the module, to cross-beams 37 by means of knot 38, provided with reference elements (non represented) for the correct coupling. On beams 36 nearly all the working operations on the machine tools are further concentrated, which are necessary in order to provide for the assembly of the module of the grate, as beams 36 are integral with the seats of all the inner and outer mechanical parts, flanges 48 and 49 coupling the successive modules and the coupling and reference surfaces to cross-beams 37 (non represented). As beams 36 have a reduced length in order to permit the transport of the modules without resorting to exceptional transport means, they can be worked with reduced times and costs with respect to the completely assembled modules of the today produced grates. The only working operations at the machine tools which are not positioned on beams 36 are those of the coupling surfaces of knot 38 which are integral with cross-beams 37 and which must be referred to the corresponding surfaces on beams 36.

Figure 5:
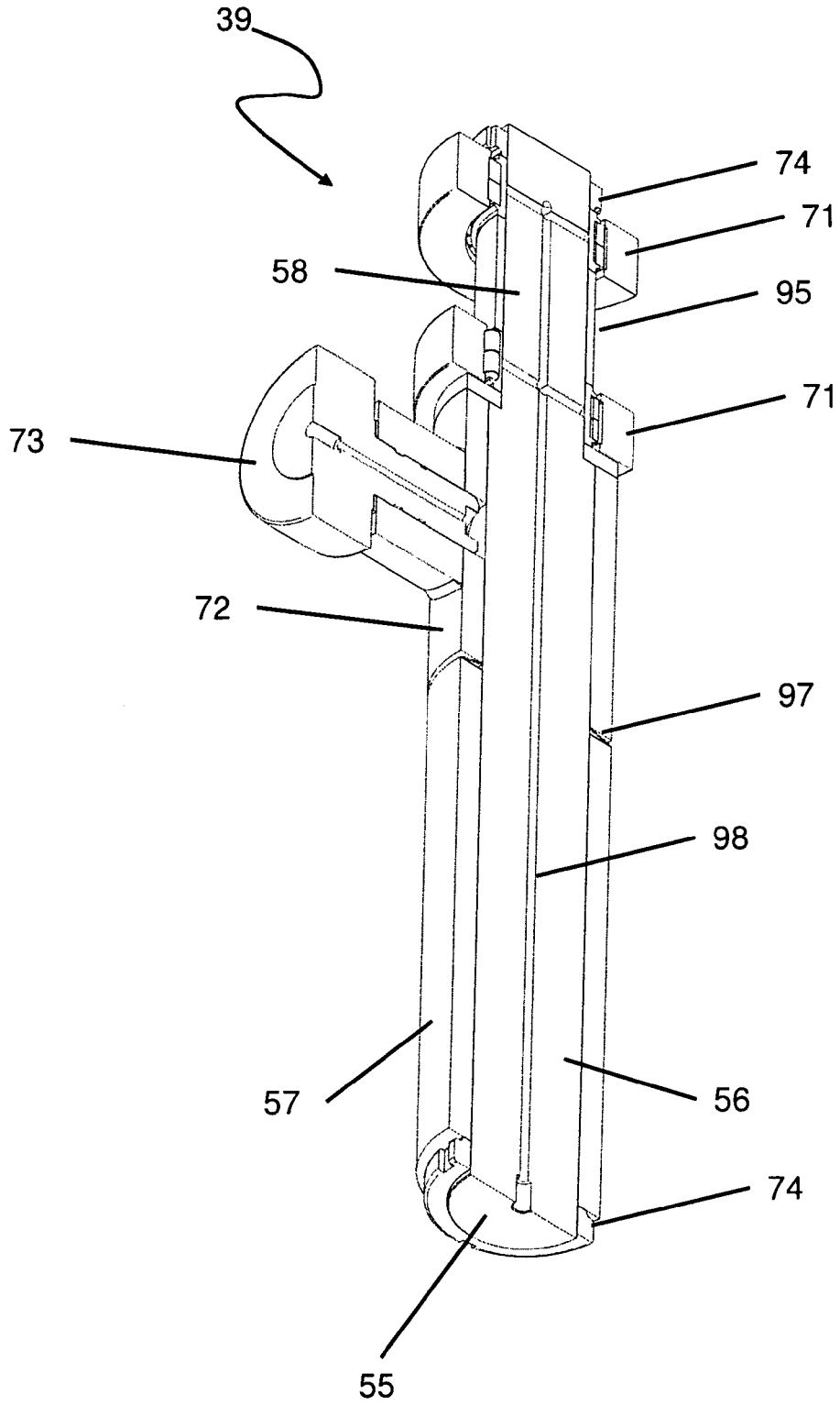
FIG. 5 shows a handling assembly comprising sliding elements and movement limiting elements.

In FIG. 5 a guide assembly of the movement of the movable frame is shown, comprising a sliding element and a movement limiting element integrally mutually coupled. Such assembly 39 comprises essentially an axis 55, which is associated to the fixed or carrying frame, formed by an outer shaft 56, which engages in a seat 57 realized inside lateral beams 36 of the carrying frame, and an inner shaft 58 instead cantilevered under the plane of the grate. On such inner shaft one or more wheels 71 with a substantially horizontal axis are fitted flush, eventually separated by a spacer 95, on which the movable frame 40 slides (non represented in this figure). On the outer shaft a bushing 72 is instead fitted flush with a sliding coupling along axis 55, to which one or more wheels 73 with a substantially vertical axis are fixed, which encounter a movable edge of the frame, in order it to be forced to move on a seat inferiorly delimited by wheels 71 and laterally by wheels 73. In a transversal direction, bushing 72 is separated by the side of seat 57 by an elastic member 97, for example realized by a cup spring or an equivalent device. The slipping of the axis from seat 57 is prevented by two ring nuts 74 which clamp between them sequentially wheels 71, spacer 95, bushing 72, elastic element 97 and seat 57.

The deformation of the elastic element permits to regulate the transversal position of the axis in order to bring wheel 73 in contact with movable frame 40. Wheels 73 are aligned with the direction of movement of the movable frame by utilizing a reference mark (non represented) integral with the bushing to which the wheels themselves are anchored. The reference mark is blocked in a seat made in the carrying frame (non represented). When movable frame 40 moves in different directions with respect to that provided for the correct advancement of fire bars 7, wheels 73 come in contact with movable frame 40 preventing its further deviation from the predetermined trajectory. Elastic element 97 permits to bushing 72 a limited sliding on outer shaft 56 following the contact with movable frame 40, and with its deformation, continuously increases starting from zero the force which maintains the movable frame 40 within the correct trajectory. At the inside of axis 55 lubrication ducts 98 are advantageously provided, for sending greases or oils to sliding wheels 71 and to movement limiting wheels 73.

The guide assembly according to the present invention has a remarkably simpler construction with respect to the known ones. First, it integrates in a single assembly made from few pieces both sliding elements 11 and movement limiting elements 12 of the movable frame. The entire assembly is further bound to the carrying frame through a single coupling shaft-hole between axis 55 and seat 57.

Assembly 39 is installed at the lateral beams 36, and so it is more protected from the dust present in the pressurized volume underneath the plane of fire bars 7, and it is immediately accessible for inspection. Wheels 71 are further cantilevered inside the pressurized volume underneath the plane of fire bars 7 and do not have any support structure, in which dust can accumulate. The result is a greater predictable feasibility and duration of wheels 71 themselves. The assembly in the indicated position allows the positioning of the inlet hole of the lubricant on the surface of the axis facing the outside of the module. In this way it is not necessary to install any lubrication tubing inside the machine.

Finally, if necessary the substitution of an entire guide assembly can be done with extreme rapidity. It is in fact sufficient to remove ring nut 74 mounted at the outside of the machine and slip the entire group from seat 57. The operation frees automatically the remaining parts, i.e. bushing 72 and the elastic member 97. With the same simplicity it is possible, by repeating in reverse the above indicated operations, to install a new assembly 39. In this way the machine shutdown times for the ordinary and extraordinary maintenance of the wheels assemblies are minimized.

The invention claimed is:

1. Waste disposal plant comprising a combustion chamber inside which waste laid on a combustion grate are burnt, which permits the entrance of an adequate quantity of combustion air in the chamber, said combustion grate comprising at least a handling group formed by a plurality of fire bars or plates, which move alternatively one with respect to the other by advancing the waste on said grate and are divided in movable fire bars and fixed fire bars, alternately disposed one with respect to another, on transversal rows resting one upon another according to a longitudinal placement with alternate steps, the fixed fire bars being bound to a fixed frame and the movable fire bars being bound to a movable frame, which moves through handling means with respect to the fixed frame the handling group comprises a guide assembly of movement of the movable frame, comprising an axis associated to the fixed or carrying frame, formed by an inner shaft on which one or more wheels are fitted flush with a substantially horizontal axis on which the movable frame slides, and an outer shaft on which a bushing with a slidable coupling along the axis is fitted flush, to which one or more wheels are fixed with a substantially vertical axis, which encounter a lateral edge of the movable frame, so that the movable frame is forced to move on a seat delimited inferiorly by the wheels of the inner shaft and laterally by the wheels of the outer shaft.

2. The plant according to claim 1, wherein the outer shaft engages in a seat realized inside lateral beams of the carrying frame and the inner shaft is cantilevered underneath the plane of the grate.

3. The plant according to claim 1, wherein in a transversal direction the bushing is separated from the side of the lateral beam by an elastic element.

4. The plant according claim 3, wherein such elastic element is a cup spring.

5. The plant according to claim 2, wherein the slipping of the axis (55) from the seat is prevented by two ring nuts which mutually block in sequence the wheels of the inner shaft, the spacer, the bushing, the elastic element and the seat.

6. The plant according to claim 3, wherein deformation of the elastic element permits regulating the transversal position of the axis to bring the wheels in contact with the movable frame.

7. The plant according to claim 1, wherein the wheels of the outer shaft are aligned with the direction of movement of the movable frame by utilizing a reference mark integral with the bushing to which the wheels of the outer shaft are anchored.

8. The plant according to claim 7, wherein the reference mark is blocked in a seat made in the carrying frame.

* * * * *